US006044896A

United States Patent [19]

Harrington

[11] Patent Number: 6,044,896

[45] Date of Patent: Apr. 4, 2000

[54] METHOD AND APPARATUS FOR CONTROLLING THE GAP IN A STRIP CASTER

[75] Inventor: Donald G. Harrington, Danville, Calif.

[73] Assignee: Alcoa Inc., Pittsburgh, Pa.

[21] Appl. No.: 09/140,720

[22] Filed: Aug. 26, 1998

Related U.S. Application Data

[60] Provisional application No. 60/056,083, Aug. 27, 1997.

[51] Int. Cl.[7] ..... B22D 11/06

[52] U.S. Cl. ..... 164/428; 164/431; 164/432

[58] Field of Search ..... 164/480, 428, 164/481, 431, 432

[56] References Cited

U.S. PATENT DOCUMENTS 3,848,658 11/1974 Hazelett et al. ..... 164/432
5,356,495 10/1994 Wyatt-Mair et al. .
5,470,405 11/1995 Wyatt-Mair et al. .
5,496,423 3/1996 Wyatt-Mair et al. .
5,514,228 5/1996 Wyatt-Mair et al. .
5,515,908 5/1996 Harrington .
5,564,491 10/1996 Harrington .

FOREIGN PATENT DOCUMENTS 0 761 343 3/1997 European Pat. Off. .
95/09708 4/1995 WIPO .

*Primary Examiner*—Kuang Y. Lin
*Attorney, Agent, or Firm*—Jongs, Tullar & Cooper

[57] ABSTRACT

A device to control the gap in between two drums or belts that are used in a strip casting apparatus. It comprises a means to move either side of the drums or belts in two planes. This ability enables the operator to control the gap to provide flexibility and increased performance during casting.

4 Claims, 4 Drawing Sheets

METHOD AND APPARATUS FOR CONTROLLING THE GAP IN A STRIP CASTER

This application claims benefit of provisional application 60/056,083 Aug. 27, 1997.

FIELD OF THE INVENTION

The present invention relates to a device and method for use in the twin belt or twin drum casting of metal strip. More specifically, the present invention relates to a device and method for adjusting the gap of a metal molding zone.

BACKGROUND OF THE INVENTION

There are devices that are known to strip cast metal, including aluminum. They include belt, drum and block casters. Generally, embodiments of each technique employ drums, belts, or blocks that are placed together in a way that their exterior surfaces create a molding zone when molten metal is placed therebetween. The position of the circular devices is typically rigidly fixed to ensure a constant gap or height in the molding zone. However, it has been discovered that there are disadvantages to permanently fixing this gap because the molding zone will vary due to thermal expansion and other reasons. Consequently, there are devices designed to vary the height of the gap. Additionally, others have developed devices to adjust the position of the nozzle that delivers the molten metal to the circular devices to accommodate changes in their position.

However, the present inventor has discovered a new way to control the casting gap and nozzle clearance simultaneously by adjusting the relative positions of the drums or pulleys that define the casting mold.

SUMMARY OF THE INVENTION

The present invention provides an apparatus and method for controlling the thickness of a cast metal strip and maintaining nozzle clearance simultaneously. The device on which it is used comprises first and second pulleys having a generally cylindrical shape, a drive and an operator side, and a surface, such as a belt or drum, that is capable of cooling molten metal, the first and second pulleys being placed in a relationship so that their surfaces (including belts) form a nip. A nozzle is used to deliver molten metal to the surface of the belts or drums. The first and second pulleys are placed in a sealing relationship with the nozzle and belts on the pulleys. Also included is a means for adjusting the casting gap at the nip, which comprises a means to move the drive or the operator sides of each pulley in the horizontal and/or vertical direction. The adjustment is capable of changing the gap of the nip while maintaining the sealing relationship between the nozzle and the belts on the pulleys.

Among other things, the present inventor has discovered a method and apparatus to control the height or gap of the nip, so as to compensate for unintended fluctuations that occur in the gap. Also, it is desirable to have this control to intentionally change the gap: 1) to adjust gap force to control cracking (in conjunction with speed); 2) to control strip wedge; 3) to provide speed turndown for transfers on coilers; 4) to enable cold starts (it eliminates the time and capital equipment required to preheat the pulleys because the thermal expansion in the gap can be controlled by the invention); 5) to compensate for the thermal expansion of the pulleys which will change the nip gap; 6) to provide an accurate means to measure gap force to determine the location of the metal sump (the location of the point where liquid turns to solid); 7) to control rolling reduction in the caster; and/or 8) to compensate for housing stretch and bearing clearances. According to the invention these objectives and advantages can be achieved while simultaneously maintaining constant clearance to the nozzle tip.

DETAILED DESCRIPTION OF THE INVENTION

The preferred casting apparatus of the present invention is related to several inventions shown in United States patents which are hereby incorporated by reference in their entireties. The U.S. Pat. Nos. that are incorporated by reference in their entirety are: 5,514,228; 5,564,491; 5,470,405; 5,496,423; 5,356,495; and 5,515,908. They relate to preferred devices and methods for twin belt casting of metal strip. While pulleys are used on the preferred device shown in these patents, twin drum casters operate similarly and should be considered to work in the present invention in a similar manner.

Figure 1:
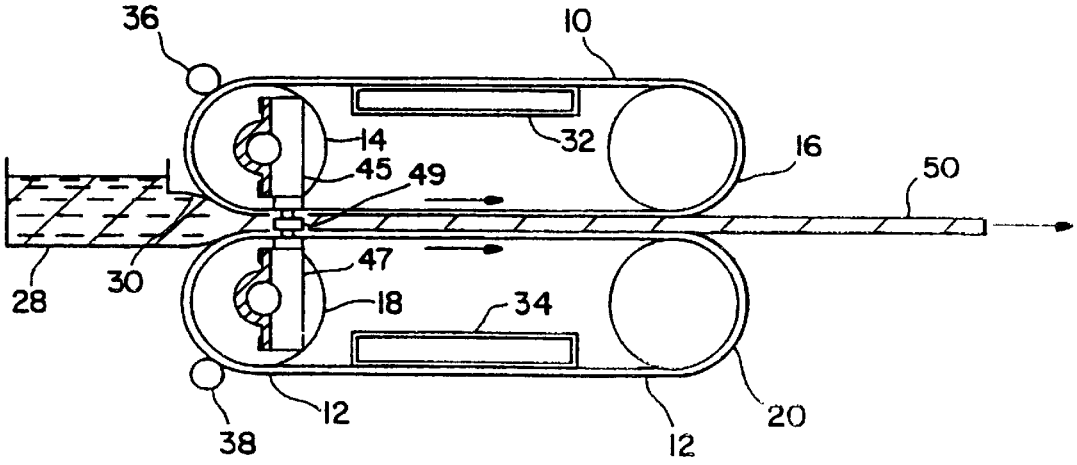
FIG. 1 shows one embodiment of a casting apparatus which can embody the present invention.
Figure 2:
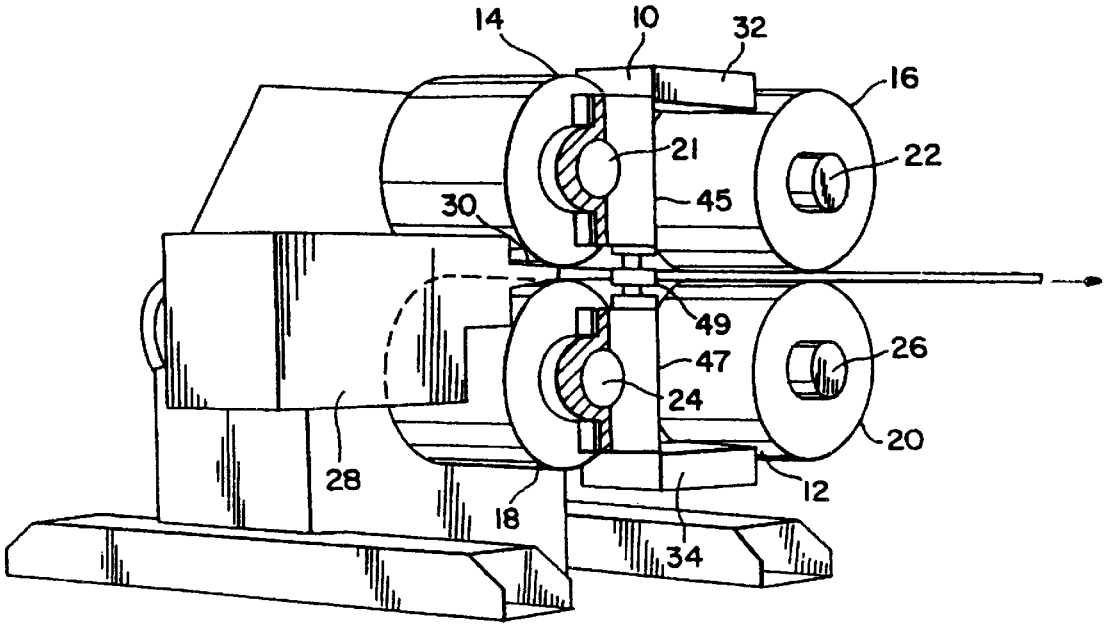
FIG. 2 is a perspective view of a portion of the apparatus shown in FIG. 1.
Figure 3:
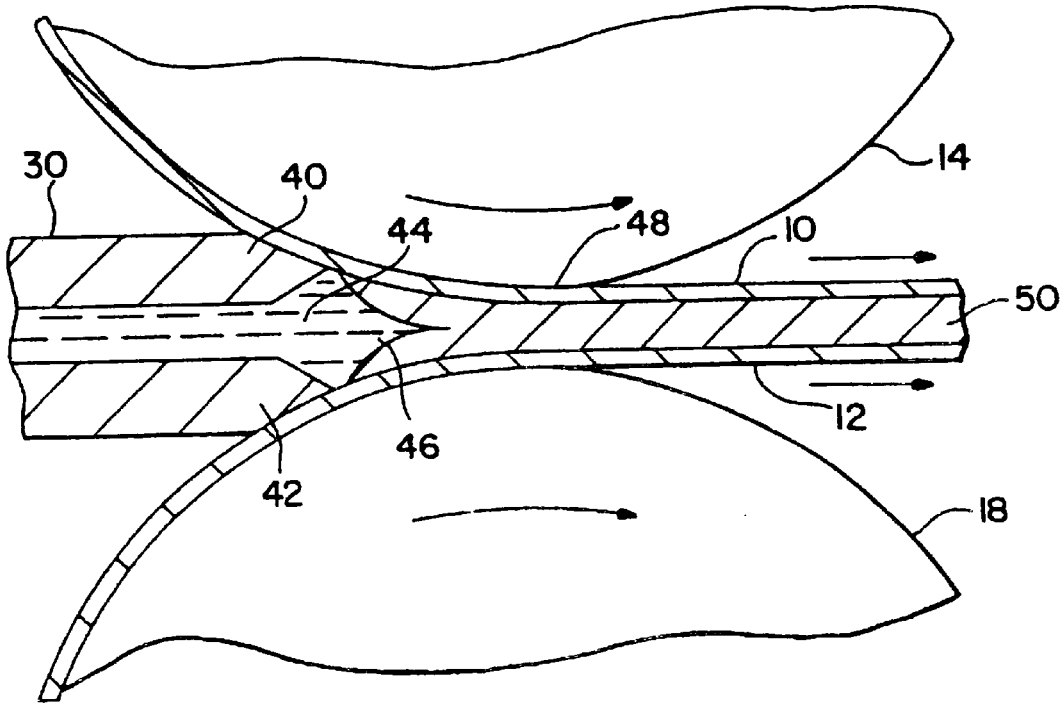
FIG. 3 is a cross-sectional view of the entry of molten metal to the apparatus shown in FIGS. 1 and 2.

A preferred metal casting apparatus which can be employed in the practice of the present invention is illustrated in FIGS. 1, 2 and 3 which are taken from commonly owned U.S. Pat. No. 5,564,491. That apparatus includes a pair of endless belts 10 and 12 carried by a pair of upper pulleys 14 and 16 and a pair of corresponding lower pulleys 18 and 20 (see FIG. 1). Each pulley is mounted for rotation about an axis 21, 22, 24, and 26, respectively (see FIG. 2). The pulleys are of a suitable heat resistant type, and either or both of the upper pulleys 14 and 16 is driven by a suitable motor means not illustrated in the drawing for purposes of simplicity. The same is equally true for the lower pulleys 18 and 20. Each pulley has a drive side that is not visible in the figure, and an operator side, which is visible in the figure. The drive side is connected to the motor means and the operator side is open and accessible to an operator of the apparatus. Each of the belts 10 and 12 is an endless belt, and is preferably formed of a metal which has low reactivity or is non-reactive with the metal being cast. As illustrated in FIGS. 1 and 2, the pulleys are positioned, one above the other with a molding zone therebetween. The gap corresponds to the desired thickness of the metal strip being cast. Thus, the thickness of the metal strip being cast is determined by the dimensions of the nip between belts 10 and 12 passing over pulleys 14 and 18. The "nip" is defined as the space between the belts measured along a line passing through the axis of pulleys 14 and 18 which is perpendicular to the belts 10 and 12. Also, the thickness of the strip being cast can be limited by the heat capacity of the belts between which the molding takes place.

Molten metal to be cast is supplied to the molding zone through suitable metal supply means 28 such as a tundish 28.

The inside of tundish 28 corresponds to the width of the product to be cast. The tundish 28 includes a metal casting nozzle 30 to deliver a horizontal stream of molten metal to the molding zone between the belts 10 and 12 (see FIG. 3). Such tundishes are conventional in strip casting.

The nozzle 30 defines, along with the belts 10 and 12 immediately adjacent to nozzle 30, a molding zone into which the horizontal stream of molten metal flows. The stream of molten metal flows substantially horizontally from the nozzle 30 to fill the molding zone between the curvature of each belt 10 and 12 to the nip of the pulleys 14 and 18. The molten metal begins to solidify and is substantially solidified prior to the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

The casting apparatus includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal.

Thus, molten metal flows horizontally from the tundish 28 through the casting nozzle 30 into the casting or molding zone defined between the belts 10 and 12 where the belts 10 and 12 are heated by heat transfer from the cast strip to the belts 10 and 12. The cast metal strip remains between, and is conveyed by, the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by scratch brush means 36 and 38 while passing over pulleys 14 and 18, they approach each other to once again define a molding zone.

The supply of molten metal from the tundish 28 through the casting nozzle 30 is shown in greater detail in FIG. 3 of U.S. Pat. No. 5,564,491. The casting nozzle 30 is formed of an upper wall 40 and a lower wall 42 defining a central opening 44 whose width may extend substantially over the width of the belts 10 and 12 as they pass around pulleys 14 and 18, respectively.

The distal ends of the walls 40 and 42 of the casting nozzle 30 are in substantial proximity to the surface of the casting belts 10 and 12, respectively, and are placed in a sealing relationship with them. The distal ends of the walls 40 and 42 define, with the belts 10 and 12, a casting cavity or molding zone 46 into which the molten metal flows through the central opening 44. The molten metal in the casting cavity 46 flows between the belts 10 and 12, and transfers its heat to the belts 10 and 12, simultaneously cooling the molten metal to form a solid strip 50 maintained between casting belts 10 and 12.

Sufficient setback (defined as the distance between first contact 47 of the molten metal 46 and the nip 48) should be provided to allow substantially complete solidification prior to the nip 48. In prior art belt casters, the molten metal contacts the belt after the nip 48 in the straight section. Hence, in the present invention solidification is substantially complete prior to the nip 48.

Freezing before the nip 48 makes the belts 10 and 12 more stable when held in tension on the curved surface of the pulley and distort much less than if the molten metal 46 first contacts the belts 10 and 12 in the straight section. Moreover, in the practice of the present invention, there is a momentary high thermal gradient over the belts 10 and 12 when first contacted by molten metal 46. Because each belt is in tension and is well supported prior to the nip by the pulleys 14 and 18, the belts are more stable against distortion arising from that momentary thermal gradient. In addition, the space between the belts at the time that they first come into contact with the molten metal is substantially larger then the gap between the belts corresponding to the thickness of the cast strip. As a result, any distortion in the belts have little effect on the metal being cast at that location. The high thermal gradient partly dissipates before the belts 10 and 12 reach the nip 48, and the presence of gap force diminishes any belt distortion as the belts approach the nip.

It is important to freeze or solidify the metal before the nip 48 because the metal solidifying between the curved surfaces in the molding zone prior to the nip 48 has a dimension or thickness greater than the corresponding dimension or thickness of the nip 48 itself. That insures that when the solidified cast metal is advanced to the nip 48, it has a larger dimension, thereby insuring that the nip 48 exerts a compressive force on the cast metal strip and thereby cause elongation to improve not only surface characteristics but also to reduce the tendency of the strip to crack. In addition, the compressive force exerted on the cast metal strip after solidification between the point of solidification and the nip itself insures good thermal contact between the cast metal strip and the belts.

The amount of compressive force is not critical. It has been found that the compressive force should be sufficiently high as to insure good thermal contact between the cast metal strip and the belt as well as sufficiently high so as to cause elongation. Preferably, the elongation is sufficient to insure that the cast metal strip, while it is conveyed from the nip 48 through the remainder of the molding zone, is in a state of compression as distinguished from tension. It has been found that maintaining the cast strip under compressive force serves to minimize cracking that would otherwise occur if the cast strip were maintained under tension.

The thickness of the strip that can be cast is related to the thickness of the belts 10 and 12, the return temperature of the casting belts and the exit temperature of the strip and belts. In addition, the thickness of the strip depends also on the metal being cast. It has been found that aluminum strip having a thickness of 0.100 inches using steel belts having a thickness of 0.08 inches provides a return temperature of 300° F. and an exit temperature of 800° F. For casting aluminum strip for a thickness of 0.100 inches using a steel belt having a thickness of 0.06 inches, the exit temperature is 900° F. when the return temperature is 300° F. and the exit temperature is 960° F. when the return temperature is 400° F.

Figure 4:
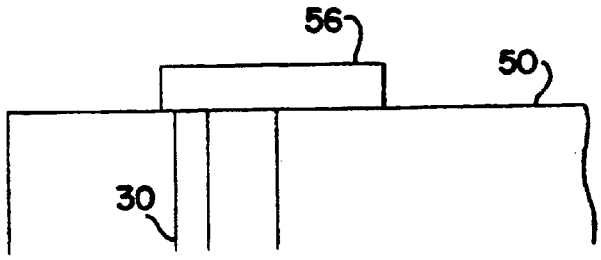
FIG. 4 shows a casting arrangment having edge containment.

It is sometimes desirable to provide means along the respective edges of the belts to contain the metal and prevent it from flowing outwardly in a transverse direction from the belt. It is accordingly possible to use a conventional edge dam for that purpose such as used on twin drum casting machines. FIG. 4 (which is taken from U.S. Pat. No. 5,515,508) shows a pair of edge dam members 56 which are positioned adjacent to the edge of belts 10 and 12. The edge dam members 56 are composed of a pair of walls extending substantially perpendicularly from the surfaces of the belts 10 and 12 to prevent the flow of molten metal outwardly from the molding zone defined between the belts. For that purpose, the edge dam elements 56 have a leading edge which is mounted forward of the casting nozzle 30 so that molten metal supplied by the casting nozzle 30 is confined between the belts 10 and 20 and the opposing edge dam elements 56. As will be appreciated by those skilled in the art, other edge containment arrangements can likewise be used in the practice of the invention.

The present device can be employed on other strip casters. For example, while the caster described above is oriented in the horizontal direction, any other orientation including vertical would also benefit from the present invention. If the caster orientation is not horizontal, then the use of the terms X and Y, or horizontal and vertical may be inappropriate. The directions of movement would be relative to the planes of the pulleys. For example, the vertical plane (of a horizontal caster) can be described as a plane that exists between the centerlines of the pulleys and could be called plane A. The horizontal plane of a horizontal caster could be called plane B, which is 90 degrees to plane A. Whether the caster operates in a vertical or horizontal orientation, it should be appreciated that the present directional controls manipulate and adjust the gap in two directions. These directions can be called XY, vertical or horizontal, or relative to the pulleys.

The preferred system to adjust the gap, or height, of the nip is composed of two directional positioning mechanisms, X and Y on either the upper or lower pulley, or both. The reasons for needing both vertical (Y) and horizontal (X) adjustments of the pulley position are as follows. Among other things, a certain amount of rolling reduction is beneficial to the quality of the strip being produced, in particular cracking can be alleviated. This means that the total thickness of the two shells formed on the pulleys is slightly larger than the gap between the pulleys. As a consequence, the thickness of the final strip is less than the sum of the two shells by the amount of the reduction. The reduction requires both torque and force to be applied to the pulleys. By adjusting the gap and measuring the rolling force the amount of reduction can be controlled. The direction controls are needed to maintain a constant fit between the feed nozzle and the moving belts as they pass around the pulleys whenever vertical gap changes are made. Movement of the nozzle is difficult because refractory materials are involved and flexible molten metal seals are more difficult to maintain the larger the motion. Other needs for gap control are compensations for housing stretch, bearing clearances, and thermal expansion as rolling loads and casting speeds change and parts heat up.

Furthermore, it is desirable to slow the caster down to increase the reliability of threading and coil transfers or to reduce the amount of scrap generated while shearing. Without gap control the speed range is limited because roll gap forces become excessive during slow downs. A 4:1 speed range is desirable.

Generally, the present gap control device serves to move one or more pulleys relative to one another to change the gap in the nip. The gap control device can be used in twin belt or drum casters (preferably a twin belt caster having pulleys) and is preferably attached to each side of the pulley to independently move either side of the pulley. The present gap control device can independently move both sides of the pulley in two directions, such as vertical and horizontal, or X and Y directions. Having this capability allows for gap control while sealing the nozzle to the surface of the pulley belt because vertically changing the height of the gap (Y direction) may necessitate a change in the horizontal dimension (X direction) and vice versa.

Figure 5:
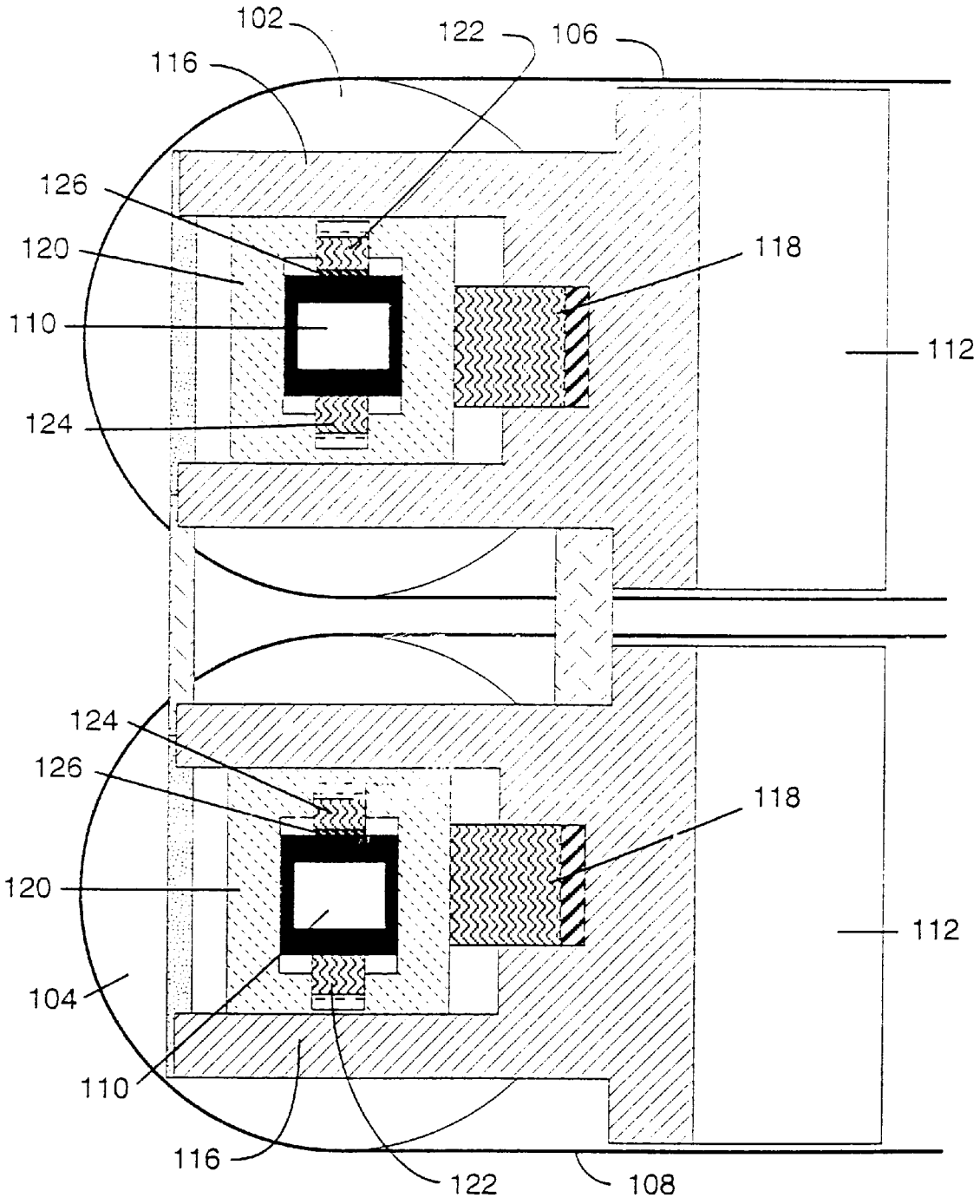
FIG. 5 shows a side view of preferred caster with a control device according to the invention.

An example of the preferred gap control device is shown in side view in FIG. 5 which shows an upper entry pulley 102 and lower entry pulley 104 having a belt attached to their respective outer surfaces 106, 108. Each pulley has a stator with a stub 110 that acts as an axle for the pulley 102, 104. The rectangular stubs are for mounting into the Y-housing, and a round portion for supporting the bearing and the pulley. It is expected that the stators 110 will be cooled and operated at a temperature only slightly elevated above ambient. Alternatively, the stator 110 could instead be a regular chock and bearing for a one-piece pulley element. An edge dam is placed at the entry of the molding zone between the upper pulley 102 and belt 106 and the lower pulley 104 and belt 108. The stators 110 are placed in housings. A carriage assemble 112 holds the X direction stator housing 116 which is moved by the X position actuator 118. The X-housing 116 is attached firmly to the carriage 112. The Y direction stator housing 120 is moved by the Y position actuator 122 in cooperation with a balance cylinder 124 and a load cell 126. Not shown are accurate position sensors associated with each actuator. The X-position actuator 118 is adjusted to maintain a constant fit between the belt 106, 108 and the lower or upper nozzle plate. The X-position actuator 118 must have sufficient force to overcome and hold the tension in the belt 106, 108. (The primary belt tension mechanism is located at the exit pulley of the caster). The X and Y actuators 118, 122 can be hydraulic, electric, or mechanical actuators, but preferably are hydraulic actuators which cause the housings to move along slides set in the housings.

Additionally, it is important to measure the gap pressure to locate the liquid sump. While a hydraulic device may be used for this measurement, other types of devices can be employed for this determination. The connection between the stators 110, the pulleys 102, 104, and their housings must allow rotation on the appropriate bearing surfaces.

Figure 6:
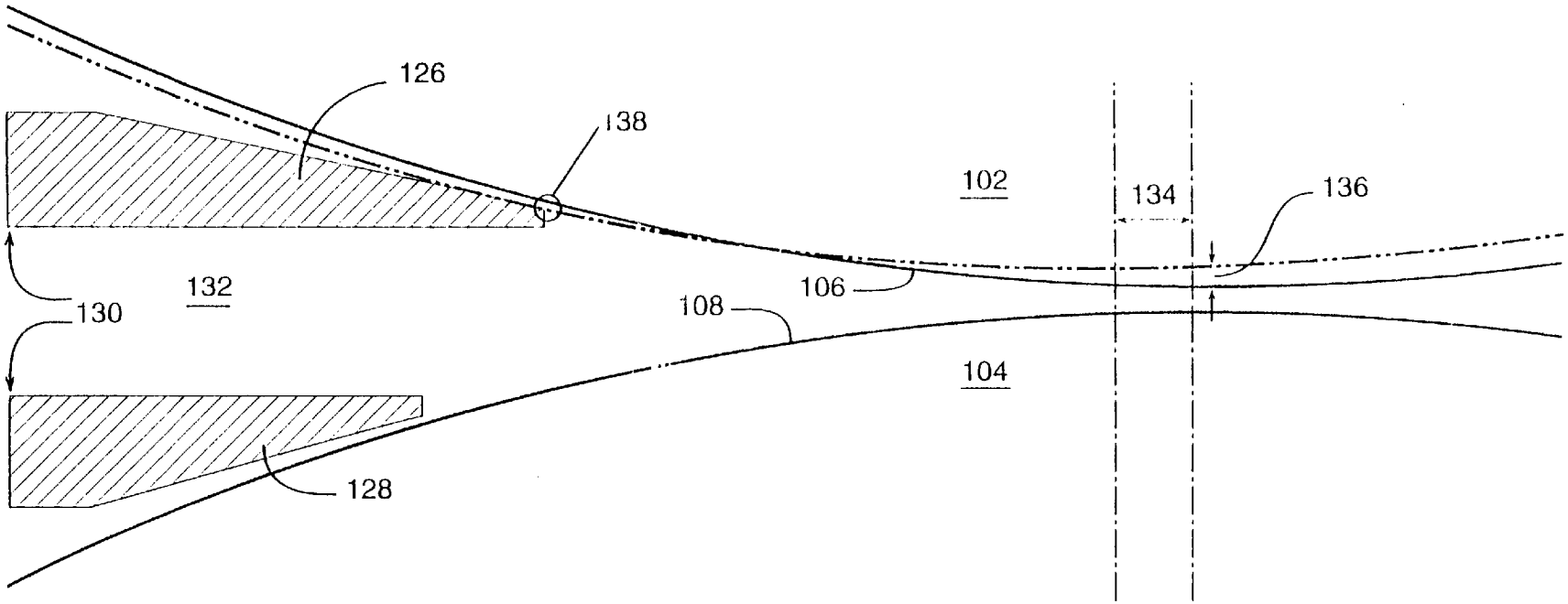
FIG. 6 shows an enlarged, cross sectional view of a nip area.

FIG. 6 shows a blow-up of the area around the nip. It comprises the upper 126 and lower 128 sides of the nozzle 130 which provide a space 132 to direct the flow of molten metal to the belts 106, 108 on the upper 102 and lower 104 pulleys. This figure shows that for a 36 inch pulley, a shift of 0.09 inches in the Y direction 136 requires a 0.5 inch shift in the X direction 134. A constant gap 138 is preferred between the upper belt 106 and the upper nozzle side 126.

The nozzle 130 is constructed of refractory materials that deliver molten metal to the moving mold surface prior to the nip. In the preferred embodiment, the nozzle remains in a fixed position. However, the upper 126 and lower 128 nozzle side can be designed to move in relation to the belt or drum. For example, the means to adjust the belt or drum can be employed on an upper pulley and the lower pulley could be in a fixed position. In this design, the lower nozzle side 128 can move in the X direction to accommodate thermal expansion while the gap correction is performed by the top pulley. Means to adjust the position of the pulley are known in the art. Combinations of fixed and movable nozzle sides can be employed with the directional control described in the present application.

The pulley preferably will operate at a temperature near that of the belt return temperature. It will be heated by the belt and insulated from the stator by an air space. The belts and pulleys can be preheated to eliminate variations in the gap due to thermal expansion.

The present invention has been described with reference to specific embodiments. However, this application is intended to cover those changes and substitutions which may be made by those skilled in the art without departing from the spirit and scope of the appended claims. For example, instead of independent vertical and horizontal actuators, there could be a single actuator that moves the pulley along a slope that maintains a constant clearance between the nozzle and the mold during gap changes at the nip.

What is claimed is:

1. An apparatus for controlling the thickness of a cast metal strip, comprising first and second pulleys or drums having a generally cylindrical shape, a drive and an operator side, and a moving surface that is capable of cooling molten metal, the first and second pulleys or drums being placed in a relationship so that their surfaces or belts thereon form a nip, a nozzle to deliver molten metal to the surface of the belts or drums, the nozzle being placed in a sealing relationship with the first and second belts or drums, a means to adjust the gap of the nip, which comprises a means to move the drive or the operator sides of either the upper or lower belt or drum in the horizontal direction independent of the opposite side of the belt or drum, and a means to move the drive or the operator sides of either the upper or lower belt or drum in the vertical direction independent of the opposite side of the belt or drum, the adjustment means being capable of changing the gap of the nip while maintaining the sealing relationship between the nozzle and the belts or drums.

2. An apparatus for controlling the thickness of a cast metal strip, comprising first and second entry pulleys having a drive side and an operator side, a first metal belt on the surface of one of the pulleys and a second metal belt on the surface of the other pulley, the first and second pulleys being placed in a relationship so that their belts form a nip having a relatively constant gap, a nozzle to supply molten metal to the belts, the nozzle being placed in a sealing relationship with the first and second endless belts, a means to adjust the gap of the nip, which comprises a means to move the drive or the operator sides of each pulley in the vertical or horizontal directions, independent of the opposite side of the pulley, the means being capable of changing the gap of the nip while maintaining sealing relationship with the belts.

3. An apparatus for controlling the thickness of a cast metal strip, comprising a first entry pulley and a first exit pulley, both pulleys supporting and moving a first endless metal belt on the surface of each pulley, a second entry pulley and a second exit pulley, both pulleys supporting a first endless metal belt on the surface of each pulley, the first and second entry pulleys having a drive side and an operator side, the first and second endless metal belts being placed in a relationship whereby their opposing belt surfaces define a molding zone, the first and second entry pulleys being placed in a relationship so that the belts form a nip having a defined gap, an upper and lower tip on a nozzle to define a conduit which supplies molten metal to the belts, the first and second endless belts being in close proximity to the upper and lower tips on the nozzle to seal the molten metal in the conduit, a means to adjust the gap of the nip, which comprises a means to independently move the drive or the operator sides of each entry pulley in the vertical or horizontal directions, the gap adjusting means being capable of changing the gap of the nip while maintaining the seal between the belts and the upper and lower tips of the nozzle.

4. An apparatus for controlling the thickness of a cast metal strip, comprising first and second entry pulleys or drums having a generally cylindrical shape, a drive and an operator side, and a moving surface that is capable of cooling molten metal, the entry pulleys or drums having a plane which connects their centerlines, called plane A, and a plane that is 90 degrees to plane A, called plane B, the first and second pulleys or drums being placed in a relationship so that their surfaces or belts thereon form a nip, a nozzle to deliver molten metal to the surface of the belts or drums, the nozzle being placed in a sealing relationship with the first and second pulleys or drums, a means to adjust the gap of the nip, which comprises a means to move the drive or the operator sides of either the entry belts or drums in plane A independent of the opposite side of the belts or drums, and a means to move the drive or the operator sides of either the entry belts or drums in plane B independent of the opposite side of the belts or drums, the adjustment means being capable of changing the gap of the nip while maintaining the sealing relationship between the nozzle and the belts on the pulleys.

* * * * *